US008511366B2

(12) United States Patent
Yang

(10) Patent No.: US 8,511,366 B2
(45) Date of Patent: Aug. 20, 2013

(54) METHOD FOR SPRAY FORMING A METAL COMPONENT AND A SPRAY FORMED METAL COMPONENT

(75) Inventor: Yunfeng Yang, Espoo (FI)

(73) Assignee: Valtion teknillinen tutkimuskeskus, Espoo (FI)

( * ) Notice: Subject to any disclaimer, the term of this patent is extended or adjusted under 35 U.S.C. 154(b) by 763 days.

(21) Appl. No.: 12/065,355

(22) PCT Filed: Aug. 30, 2006

(86) PCT No.: PCT/FI2006/000287

§ 371 (c)(1),
(2), (4) Date: Aug. 26, 2008

(87) PCT Pub. No.: WO2007/026045

PCT Pub. Date: Mar. 8, 2007

(65) Prior Publication Data

US 2009/0220810 A1 Sep. 3, 2009

(30) Foreign Application Priority Data

Aug. 30, 2005 (FI) ..... 20055457

(51) Int. Cl.
*B22F 3/115* (2006.01)
*B22D 23/00* (2006.01)

(52) U.S. Cl.
USPC ..... 164/46; 164/45

(58) Field of Classification Search
USPC ..... 164/46, 45
See application file for complete search history.

(56) References Cited

U.S. PATENT DOCUMENTS

| | | | | |
|---|---|---|---|---|
| 5,167,218 | A * | 12/1992 | Deakin | 126/569 |
| 6,135,194 | A * | 10/2000 | Flinn et al. | 164/46 |
| 6,308,765 | B1 * | 10/2001 | Grinberg et al. | 164/34 |
| 6,447,704 | B1 * | 9/2002 | Covino | 264/219 |
| 7,350,558 | B2 * | 4/2008 | Grinberg | 164/46 |
| 2003/0209589 | A1 | 11/2003 | Hasz et al. | |
| 2004/0035543 | A1 * | 2/2004 | Grinberg et al. | 164/46 |

FOREIGN PATENT DOCUMENTS

| | | | |
|---|---|---|---|
| EP | 0 346 222 | A1 | 6/1989 |
| WO | WO 2004035250 | A1 * | 4/2004 |
| WO | WO 2005/077501 | A1 | 2/2005 |

OTHER PUBLICATIONS

Machine Translation, Jacquemin et al., EP 0346222, Dec. 1989.*

* cited by examiner

*Primary Examiner* — Devang R Patel
(74) *Attorney, Agent, or Firm* — Merchant & Gould P.C.

(57) ABSTRACT

A method for spray forming a metal component (11, 17, 21, 27) having an elongated open channel (10, 20, 22, 28) therein comprises firstly spray forming a layer (8, 19, 24) of the desired metal onto a deposition substrate (2), placing then an elongated spray blocking object (9, 18, 26, 29) on the already sprayed layer for forming the channel, and continuing then the spray forming process until the desired total thickness of the component is achieved. According to the present invention, the spray blocking object is a strip (18, 26, 29), the cross-sectional profile of the strip being fully open in the direction of an axis (a) in a cross-sectional plane of the strip, and the strip is placed on the already deposited layer (8, 19, 24) with said axis directed substantially parallel to the direction of the incident metal spray (6).

4 Claims, 2 Drawing Sheets

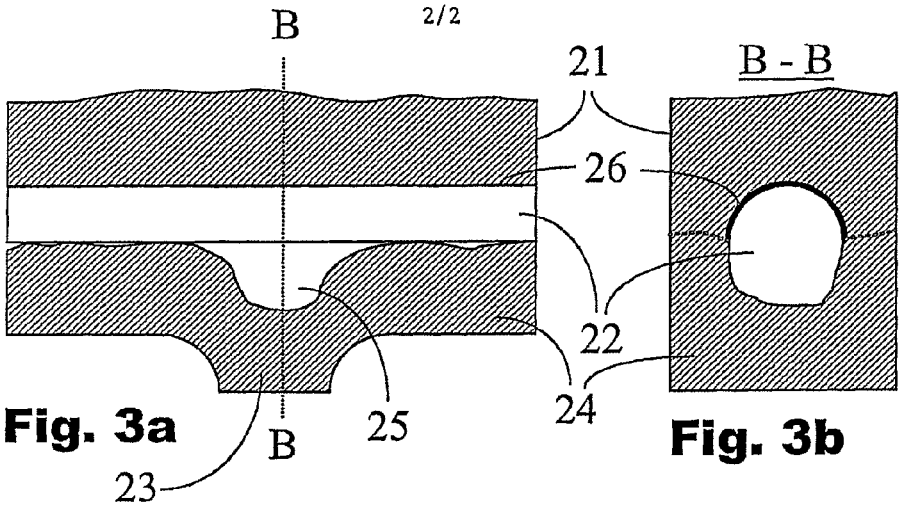
Fig. 3a
Fig. 3b
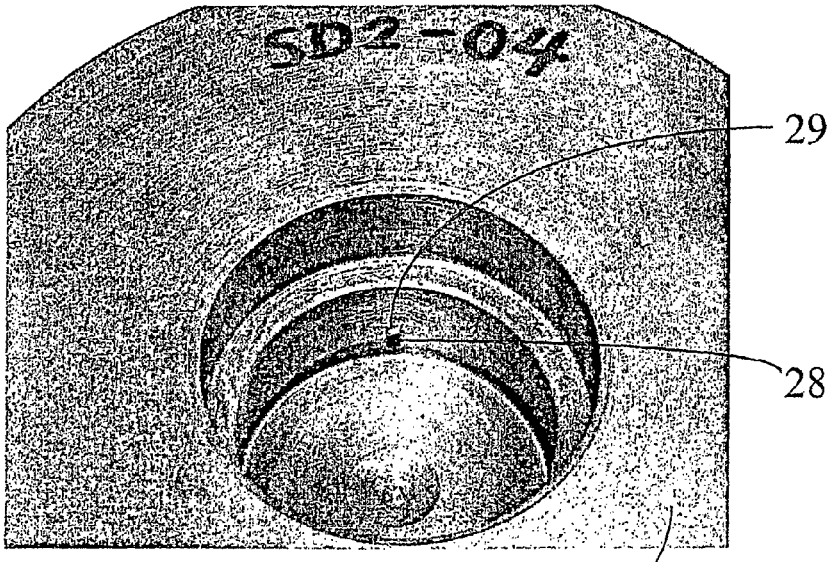
Fig. 4

METHOD FOR SPRAY FORMING A METAL COMPONENT AND A SPRAY FORMED METAL COMPONENT

FIELD OF THE INVENTION

The present invention relates to manufacturing of metal components with cooling channels by spray forming techniques, and to such components.

BACKGROUND OF THE INVENTION

Spray forming is a unique solidification process in which metal melt is atomised by inert gas into droplets of 10-200 microns in size, flying at subsonic speed onto a deposition substrate. During the flight the droplets are rapidly cooled with a cooling rate between 100 to 100,000 degrees per second in a controlled way so that the solidification of the metal is not dependent on the temperature and/or the thermal properties of the deposition surface like a mould. The particles arriving at the mould are in such a condition that welding to the already deposited metal is complete and no interparticle boundaries are developed. As a result, high-quality materials are made with fine, equiaxed and homogeneous microstructures. These features are especially prominent in making high-alloy metal components like for example die inserts and tooling heads.

Such components often need cooling for proper operation and for preventing overheating shortening the component lifetime and possibly leading to damages. Traditionally cooling channels have been made by machining. However, drilling the channels into usually very hard spray formed material is troublesome and time consuming. There have also been practices to form the cooling channels already during the spray forming process by setting metal tubes on the deposited material at an intermediate stage of the process. After subsequent deposition to the final thickness of the structure, the tubes form open channels within the component.

There are, however, many problems in this approach. At first, the tubes create a shadowing effect which prevents deposition of sprayed metal below them. This leads to empty gaps formed below the tubes in the areas where the spray can't fall, which in turn impairs the cooling efficiency and often causes stresses, distorting or even cracking of the component. In addition, the upper surface of the sprayed material usually follows the profile of the deposition substrate. In contrast, the metal tubes to be placed on this kind of surface are rigid. Thus, the more there are vertical changes in that surface the more there are cavities around the tube decreasing the cooling efficiency.

PURPOSE OF THE INVENTION

The purpose of the present invention is to provide a new method for spray forming a metal component having a cooling channel therein as well as to disclose a novel spray formed metal component having a cooling channel therein, by which method and component the problems described above are alleviated.

SUMMARY OF THE INVENTION

The method according to the present invention is characterised by what is presented in claim 1. Respectively, the spray formed metal component according to the present invention is characterised by what is presented in claim 3.

The method of the present invention for spray forming a metal component having an elongated open channel for cooling purposes therein comprises firstly spray forming a layer of the desired metal onto a deposition substrate which can be for example a ceramic mould. In spray forming, any of known spray forming processes, as for example the Osprey™ process, RSP Tooling™ developed by INEEL (The Idaho National Engineering and Environmental Laboratory, USA) or Ford Rapid Tooling process developed by Ford Motor Corporation and Oxford University, can be used. The first layer thickness depends, for example, on the total thickness of the component to be fabricated, the metal used and the cooling efficiency needed. The thickness of the layer is controlled by the duration of spray so that preferably a substantially uniform thickness following the deposition substrate surface profile is formed. After reaching the desired thickness of the first layer, the method next comprises placing an elongated spray blocking object on the already deposited layer for forming the open channel. Finally the spray forming process is continued until the desired total thickness of the component is achieved. Spray blocking means that the metal spray can not penetrate through the spray blocking object. In other words, the spray blocking object creates a shade where the metal can not reach, resulting in an open elongated channel to be formed in the area of the shade.

According to the present invention, the spray blocking object is a strip, the cross sectional profile of the strip being fully open in the direction of an axis in the cross-sectional plane of the strip. This kind of strip is placed on the already deposited layer with said axis directed substantially parallel to the direction of the incident metal spray. Fully open in the direction of said axis means that the cross-sectional profile has no undercuts in this direction. In other words, when viewed in the direction of said axis from either side of the strip, the corresponding surface of the strip is entirely in sight. From the point of view of the incident metal spray, this means that when directed as defined in the claims, the strip creates no other shade than the volume of the channel itself. The direction of the incident metal spray means the direction along the central axis of typically conical spray.

Several important advances are achieved by this method. In contrast to the prior art solutions, the lower boundary of the channel is defined by the surface of the firstly deposited layer itself. Hence, the coolant flowing in the channel is in direct contact with the component body, improving thermal connection between the coolant and the component. In addition, the channel boundary then automatically conforms to the height variations of said surface. In addition, as described above, the fully open profile prevents formation of any harmful gaps or pores around the channel. All these features together enable efficient cooling to be arranged throughout the component.

In one preferred embodiment of the present invention, the cross-sectional profile of the strip is an open arc, for example a half circle, and the strip is placed on the already deposited layer with the convex side of the arc directed towards the incident metal spray, so that the channel will be formed in the concave side of the strip. These kinds of strips with a curved cross section can be easily fabricated for example by splitting a round tube. An arc is also a rather rigid shape allowing making the strip quite thin. However, any profile fully open in one direction as defined in the claims is possible. Thus, the profile of the strip can also be for example a triangle or three sides of a rectangle. Even a planar strip can be used.

A spray formed metal component according to the present invention has an elongated open channel therein. According to the present invention, a portion of the cross-sectional boundary of the channel is defined by an elongated strip being in a tight contact with the component body around the channel while the remaining portion of the boundary is defined by the component body itself. Tight contact means that there are no gaps or pores around the channel. In addition, the component body as a part of the channel boundary provides a direct thermal connection between coolant in the channel and the component.

Preferably the strip has a cross-sectional profile of an open arc, for example a half circle. This kind of profile enables easy manufacturing of the component as described above.

The metal component of the present invention can be for example a die insert, a tool, or some other component necessitating high material quality achievable by a spray forming process. Examples are tools used at elevated temperatures, for instance, in die-casting, injection moulding, blow moulding, and hot working. Enhanced cooling will not only improve the component lifetimes, but also increase the productivity by reducing the part cycle time. In plastic injection moulding, for example, conformal cooling has been shown to reduce part cycle time by 15-50% compared to standard cooling practices.

BRIEF DESCRIPTION OF THE DRAWINGS

The accompanying figures, which are included to provide a further understanding of the invention and constitute a part of this specification, together with the description explain the principles of the invention.

FIGS. 3*a* and 3*b* illustrate a cooling channel manufactured according to the present invention.

FIG. 4 shows an example of a spray formed metal component according to the present invention.

DETAILED DESCRIPTION OF THE INVENTION

Reference will now be made in detail to the embodiments and examples relating to the present invention, which are illustrated in the accompanying figures.

Figure 1:
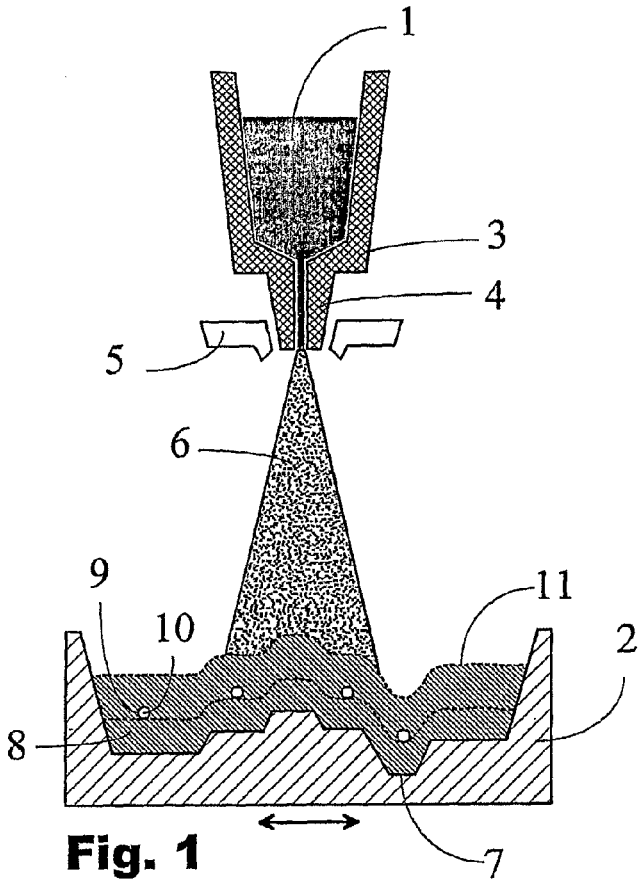
FIG. 1 shows a schematic figure of a basic arrangement for spray forming metal components having cooling channels therein.

The arrangement of FIG. 1 illustrates the method of spray forming metal components with cooling channels. Molten metal 1 to be sprayed onto a ceramic mould 2 is fed from a heated reservoir 3 through a nozzle 4 and an atomizer 5 where metal is mixed to cool inert gas, resulting in a spray 6 of rapidly cooling metal droplets directed to the mould. At the mould 2 the metal deposits so as to have a fine and homogenous microstructure producing a nearly net-shape component surface 7. The mould 2 is movable horizontally with respect to the nozzle for covering by the spray 6 the whole mould area. As shown in the figure, after growth of a layer 8 with a substantially uniform thickness, elongated shading objects 9 have been laid on said layer in order to form open channels 10 within the sprayed structure 11 during continuation of the spraying process.

Figure 2A:
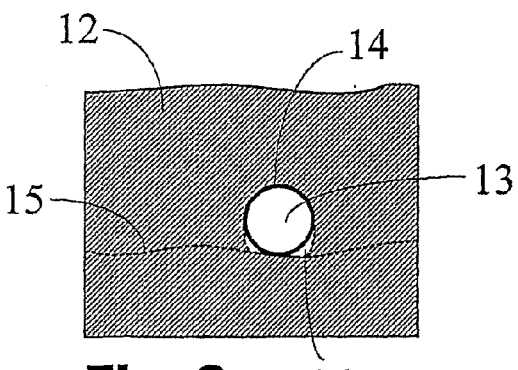
Fig. 2a (Prior Art)
FIGS. 2*a* and 2*b* represent a comparison between a prior art spray formed metal component and a spray formed component according to the present invention.
Figure 2B:
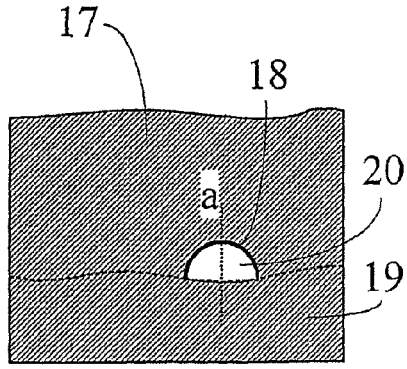

FIGS. 2*a* and 2*b* show the essential differences between the prior art solutions and the present invention. FIG. 2*a* shows as a cross section a part of a component 12 in which a cooling channel 13 has been formed using a round pipe 14 laid on a sprayed metal surface 15 in an intermediate stage of the process. Due to a shadowing effect, empty gaps 16 have been formed below the pipe 14 on both sides of it during the further spraying, leading to a decreased cooling efficiency. Instead, in a piece of a component 17 shown in 2*b* an elongated strip 18 with a cross section of a half circle has been used on a firstly deposited layer 19 for forming a cooling channel 20 in the structure. The imaginary central axis "a" of the half circle has been directed along the direction of the metal spray, the convex side of the half circle being towards the incoming spray. The upper part of the channel boundary is thus formed by the bottom side of the strip 18 while the surface of the firstly sprayed metal layer 19 itself defines the lower part of the boundary. Because the cross-sectional profile of the strip 18 is fully open downwards, i.e. in the direction which during the spraying process have been away from the incident spray, no cavities or gaps have been formed around the channel but the top side of the strip is in a tight contact with the surrounding component body. Thus, effective cooling performance is enabled.

FIGS. 3*a* and 3*b* are a longitudinal sectional view and a cross section view, respectively, of a spray formed component 21 having a cooling channel 22 therein. The component has a bottom protrusion 23 defined by a hollow in the mould on which the component has been deposited. A layer 24 sprayed at first naturally has on its top surface a hollow 25 corresponding to the protrusion 23. Before continuing the process, an elongated spray blocking strip 26 having a cross section of a half circle has been placed on the firstly sprayed layer 24 with the convex upper side of the strip being directed towards the direction of incidence of the metal spray. As a result, a channel 26 has been formed below the lower side of the strip 26. Because the lower part of the channel boundary is defined by the firstly sprayed layer 24 itself, the bottom of the channel 26 conforms to the surface of that layer also at the hollow 24. In other words, the cooling channel 26 adjusts itself to the vertical changes of the mould surface ensuring efficient cooling capacity throughout the component 21. In contrast, in case a prior art tube were used as the channel forming shading object, the hollow would have led to an empty volume below the channel, essentially impairing the thermal connection between the component body and a coolant in the cooling channel 26.

A spray formed die insert 27 is shown in FIG. 4. There is a cooling channel 28 in the die insert 27 having been formed by using a 2 mm wide wire 29 as a spray blocking object.

It is obvious for a person skilled in the art that with the advancement of technology, the basic idea of the invention may be implemented in various ways. The invention and its embodiments are thus not limited to the examples described above; instead they may vary within the scope of the claims.

The invention claimed is:

1. A method for spray forming a metal component having an elongated open channel therein, the method comprising firstly spray forming a layer of the desired metal onto a deposition substrate, placing an elongated spray blocking object on the already sprayed layer for forming the channel, and continuing the spray forming process covering the already sprayed layer and the elongated spray blocking object until the desired total thickness of the metal component is achieved, wherein the metal component and the elongated spray blocking object form the channel, and the elongated spray blocking object is not removed after spray forming process, wherein a portion of a cross-sectional boundary of the channel is defined by the elongated spray blocking object being in contact with the metal component, and wherein the spray blocking object is a strip, the cross-sectional profile of the strip being fully open in the direction of an axis in a cross-sectional plane of the strip, and that the strip is placed on the already deposited layer with said axis directed substantially parallel to the direction of the incident metal spray.

2. A method according to claim 1, wherein the cross-sectional profile of the strip is an open arc, and that the strip is placed on the already deposited layer with the convex side of the arc directed towards the incident metal spray.

3. A method according to claim 1, wherein the elongated open channel comprises a first end and a second end and is constructed to allow coolant to flow from one of the first end or the second end to the other of the first end or the second end to provide cooling.

4. A method according to claim 1, wherein a remaining portion of the cross-sectional boundary of the channel is defined by the metal component.

* * * * *